US006634584B1

(12) United States Patent
Byrne et al.

(10) Patent No.: US 6,634,584 B1
(45) Date of Patent: Oct. 21, 2003

(54) STONE MOUNTING SYSTEM

(75) Inventors: John Byrne, Clinton, MS (US); Michael W. Rouse, Vicksburg, MS (US)

(73) Assignee: Rouse Holdings, Inc., Vicksburg, MO (US)

( * ) Notice: Subject to any disclaimer, the term of this patent is extended or adjusted under 35 U.S.C. 154(b) by 69 days.

(21) Appl. No.: 09/596,059

(22) Filed: Jun. 16, 2000

Related U.S. Application Data

(60) Provisional application No. 60/149,272, filed on Aug. 17, 1999.

(51) Int. Cl.[7] ..... B02C 7/12
(52) U.S. Cl. ..... 241/296
(58) Field of Search ..... 241/296, 261.2, 241/291, 300; 451/548

(56) References Cited

U.S. PATENT DOCUMENTS

| | | | | | |
|---|---|---|---|---|---|
| 483,179 | A | * | 9/1892 | Sturtevant | 241/296 |
| 881,621 | A | * | 3/1908 | Rowland et al. | 451/548 |
| 1,204,102 | A | * | 11/1916 | Whitford | 451/548 |
| 1,449,958 | A | * | 3/1923 | Schifferdecker | 241/296 |
| 2,118,409 | A | * | 5/1938 | Loewy | 451/548 |
| 2,121,275 | A | * | 6/1938 | Zober et al. | 241/296 |
| 3,579,923 | A | * | 5/1971 | Whited | 451/548 |
| 3,716,951 | A | | 2/1973 | Walters et al. | |
| 4,841,623 | A | | 6/1989 | Rine | 29/525.1 |
| 5,238,194 | A | | 8/1993 | Rouse et al. | |
| 5,334,641 | A | | 8/1994 | Rouse | |
| 5,411,215 | A | | 5/1995 | Rouse | |
| 5,468,176 | A | | 11/1995 | Udert et al. | |
| 5,525,653 | A | | 6/1996 | Rouse | |
| 5,564,634 | A | | 10/1996 | Rouse et al. | |
| 6,238,267 | B1 | | 5/2001 | Rouse | |
| 6,238,448 | B1 | | 5/2001 | Rouse et al. | |

FOREIGN PATENT DOCUMENTS

| | | |
|---|---|---|
| CH | 391434 | 4/1965 |
| FR | 2123856 | 9/1972 |
| FR | 2190034 | 1/1974 |

* cited by examiner

*Primary Examiner*—Lowell A. Larson
(74) *Attorney, Agent, or Firm*—Connolly Bove Lodge & Hutz LLP

(57) ABSTRACT

A comminuting apparatus for reducing the size of particles, having a frame providing an internal perimeter and having a shape; a stone having a grinding surface for grinding a material and providing a perimeter having a shape corresponding to the shape of the perimeter of the frame and configured to be at least partially surrounded by the frame; wherein when the frame is rotated the perimeter of the frame is configured to coact with the perimeter of the stone such that the stone is rotated at substantially the same rate as the frame.

5 Claims, 10 Drawing Sheets

STONE MOUNTING SYSTEM

This application claims the benefit of U.S. Provisional Application No. 60/149,272, filed on Aug. 17, 1999; the contents of which including title, specification, claims, and figures are incorporated by reference.

FIELD OF THE INVENTION

The present invention relates generally to a grinding system in the field of comminuting devices. More particularly, the present invention relates to a mounting system for coupling a stone to a frame.

BACKGROUND OF THE INVENTION

A known method for mounting a grinding stone includes locking the stone to a backing plate via a taper, which applies a compression force or stress on the outer perimeter of the stone to hold the stone in a stationary position with respect to the backing plate. Such stress is partially counteracted by the centrifugal forces applied to the stone while in operation (i.e., rotation). Accordingly, the stone must be subjected to greater stress via the mounting taper lock than is imparted upon the stone while in operation, otherwise the stone would "spin" relative to the backing plate.

Another known method for mounting a grinding stone includes an arbor that extends through a center hole of the stone, which is typically threaded such that a nut can be tightened to apply a compressive force on the inner portion of the stone, thus holding it stationary with respect to the arbor. However, a problem with such known mounting methods is that significant stress must be applied to the stone before the grinder is turned on and/or are complicated, time consuming and costly.

SUMMARY OF THE INVENTION

Accordingly, it would be advantageous to substantially reduce or eliminate the pre-stress applied to a grinding stone, thereby reducing the overall stress to which the stone will be subjected while in operation. It would also be advantageous to reduce the stress applied to the stone as the rotational speed of the stone is reduced. It would also be advantageous to provide a stone mounting system made of low cost materials. It would also be advantageous to provide a mounting plate or frame that does not require removal of the stone from the grinder each time the stone is changed. It would also be advantageous to provide for a method of mounting a stone that would allow a stone that has been in operation (e.g., used) to be removed from the grinder without damaging the stone such that it can be examined, repaired, replaced or used again. It would also be advantageous to have the shape of the frame in the same shape of the mount so that the two may rotate together. It would also be advantageous to provide for stone changes that can be performed quickly.

BRIEF DESCRIPTION OF THE DRAWINGS

The invention will become more fully understood from the following detailed description, taken in conjunction with the accompanying drawings, wherein like reference numerals refer to like pans, in which.

DETAILED DESCRIPTION OF THE PREFERRED EMBODIMENTS

Figure 1B:
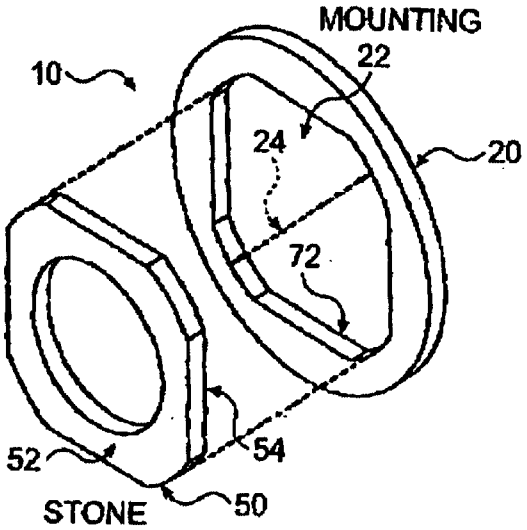
FIG. 1 is an exploded perspective view of a stone mounting system according to a preferred embodiment of the present invention.
Figure 1A:
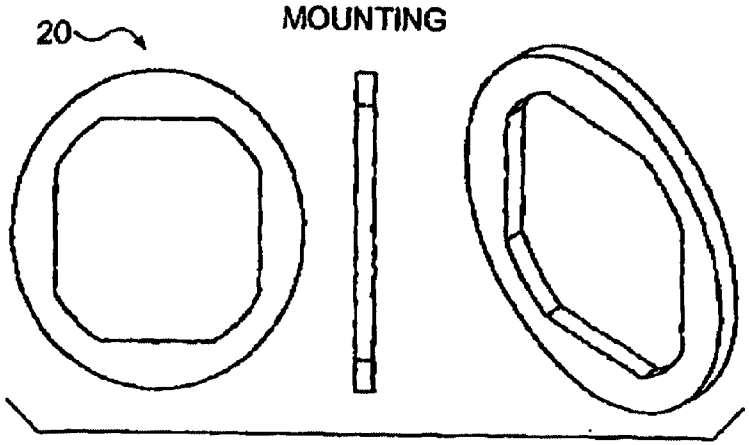
Figure 1C:
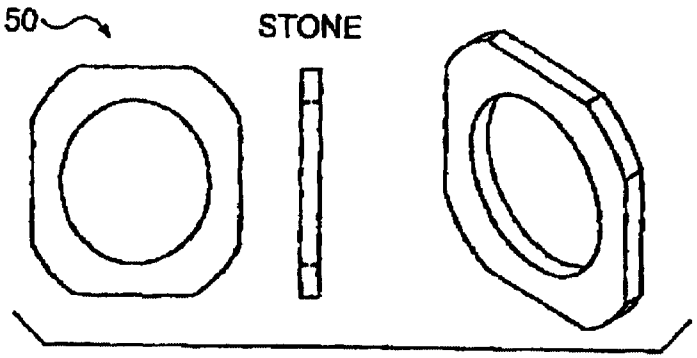

Referring to FIG. 1, a stone mounting system 10 is shown according to a preferred embodiment of the present invention. System 10 includes a housing, base plate, mounting surface or backing plate (shown as a frame 20) coupled to an abrasive wheel (shown as a grinding stone 50) having a grinding surface 52 and a backing surface 54. Frame 20 is generally circular shaped and includes an aperture 22 having a diameter 24 with multiple oblique flats 26. The shape of the perimeter of the stone 50 approximately corresponds to the shape of the aperture 22. (i.e., generally circular with oblique flats) Stone 50 may be inserted within aperture 22 of frame 20 such that the perimeter of stone 50 abuts against the perimeter of aperture 22 at a mounting interface 72 such that stone 50 is "locked" or fixed in place relative to frame 20. The four flats advantageously distribute the rotational forces (loadings) on to several points, thus helping to avoid stone failure.

When frame 20 is subjected to a rotational force (such as by a crank, wheel, rod, shaft, arbors running through the aperture of the stone, etc.) stone 50 likewise rotates, but is substantially inhibited from independently rotating relative to frame 20 due to the geometric shapes of stone 50 and frame 20. Because the perimeter of stone 50 is not exactly circular shaped, stone 50 does not generally slip or slide within aperture 22 when frame 20 is rotated.

In one embodiment, two substantially identical mounting systems may be placed in a facing relationship (not shown) in a disc or attrition mill (e.g., grinding machine) such that two or more stone faces can be placed in contact with each other. In another embodiment, one mounting system paces and rotates against another object, which may be fixed and/or different from the mounting system. To keep the stones from turning (i.e., not lock together due to the contact forces between them) each stone should be held in position relative to the frame of that stone. A material (such as rubber, biological products, agricultural products, elastomers, plastics, etc.) may be provided between two grinding surfaces 52 of two stones in a facing relationship in the grinding machine. The size of the material may be reduced by grinding it between the two grinding surfaces. The material may be ground pure or mixed with other materials such as by making a slurry and mixing the material with a liquid. Further, this invention can include the mounting of a single abrasive wheel, using the mounting method of the present invention, for the purpose of placing the single abrasive wheel in a facing relationship in a disc or attrition mill. Thereby the abrasive wheel is faced with any other type of grinding surface. The abrasive wheel face and the face of the other surface are thus capable of grinding any material between themselves.

Figure 2B:
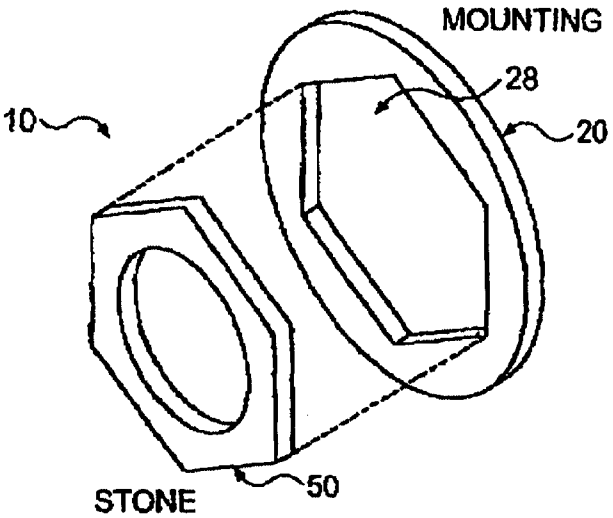
FIG. 2 is an exploded perspective view of the stone mounting system according to an alternative embodiment of the present invention.
Figure 2A:
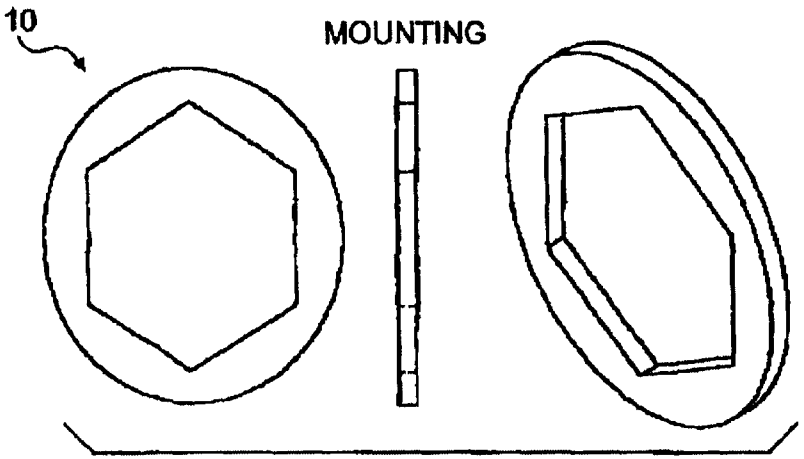
Figure 2C:
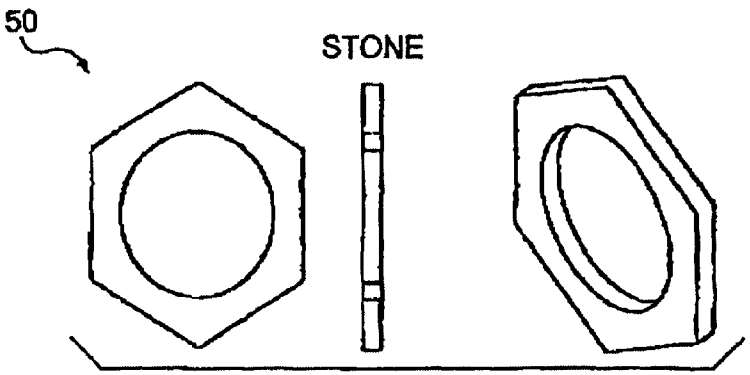

Referring to FIG. 2, system 10 is shown according to an alternative embodiment of the present invention. Aperture 22 of frame 20 is generally hexagonal shaped and the perimeter of stone 50 is correspondingly hexagonal shaped. Stone 50 fits within aperture 22 of frame 20 such that stone 50 is rotated when frame 20 is rotated.

Figure 3B:
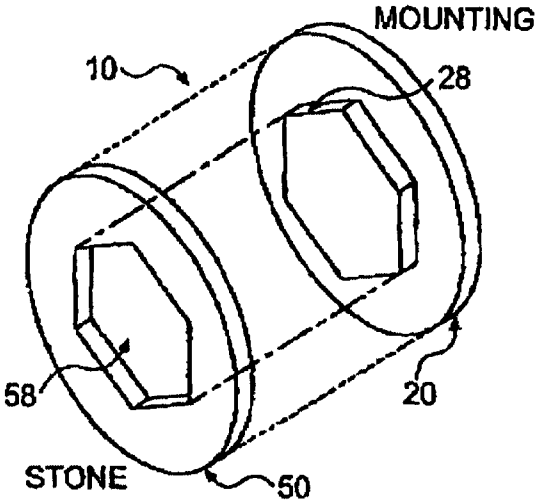
FIG. 3 is an exploded perspective view of the stone mounting system showing a frame boss according to an alternative embodiment of the present invention.
Figure 3A:
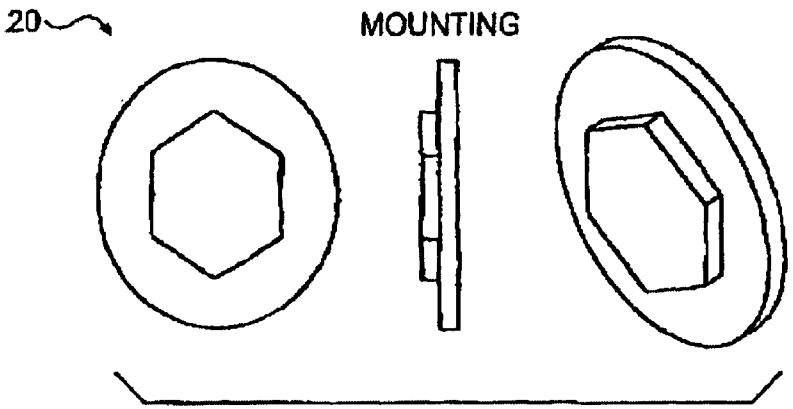
Figure 3C:
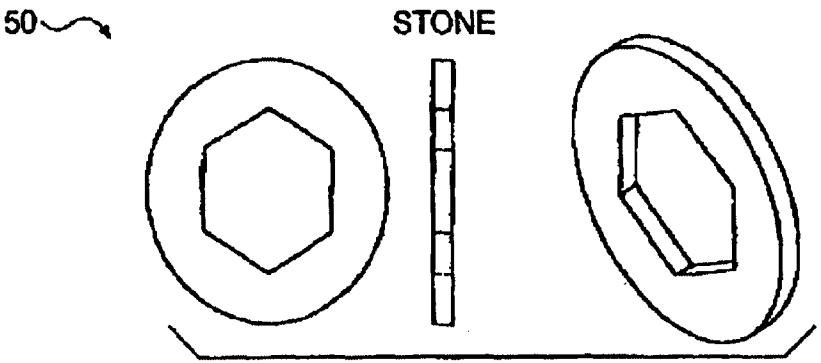

Referring to FIG. 3, system 10 is shown according to an alternative embodiment of the present invention. A protruding portion shown as a boss 28 extends from frame 20. Boss 28 is generally hexagonal shaped. An aperture 58 of stone 50 is correspondingly hexagonal shaped. Boss 28 fits within aperture 58 of stone 50 such that stone 50 is rotated when frame 20 is rotated.

Figure 4B:
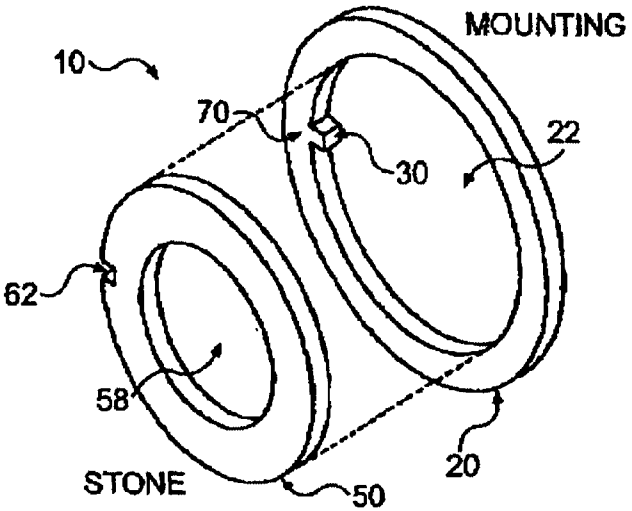
FIG. 4 is an exploded perspective view of the stone mounting system showing a frame protrusion according to an alternative embodiment of the present invention.
Figure 4A:
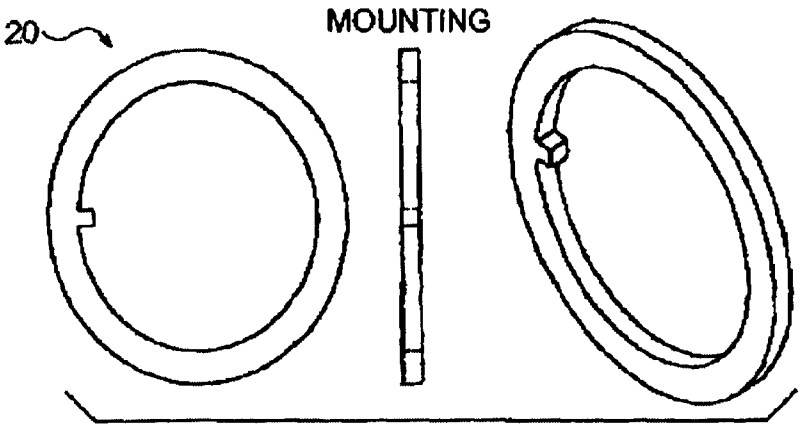
Figure 4C:
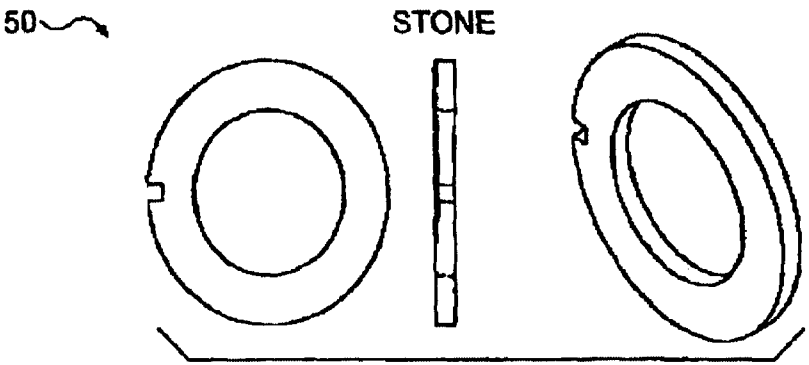

Referring to FIG. 4, system 10 is shown according to an alternative embodiment of the present invention. Aperture 22 of stone 20 is generally circular shaped and the perimeter of stone 50 is correspondingly circular shaped. Frame 20 provides a locking system 70 including a protrusion shown as an outwardly extending finger 30 of frame 20, and a recess shown as an inwardly extending finger 62 of stone 50. Stone 50 fits within aperture 22 of frame 20 and finger 30 interconnects with finger 62 such that stone 50 is rotated when frame 20 is rotated. According to alternative embodiments, the locking system may include a keyway as used in a locking a pulley on a shaft.

Figure 5B:
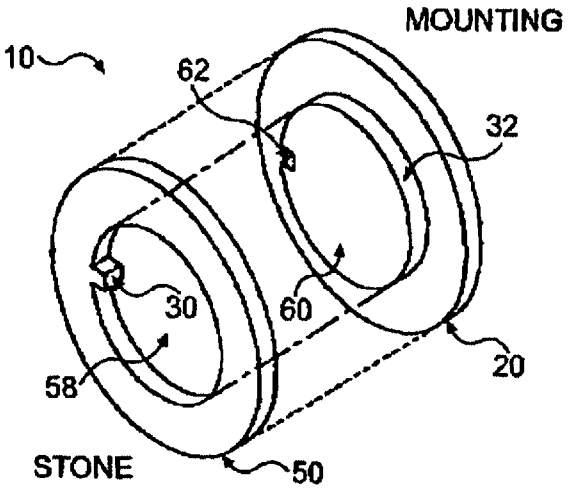
FIG. 5 is an exploded perspective view of the stone mounting system showing a frame boss and a stone protrusion according to an alternative embodiment of the present invention.
Figure 5A:
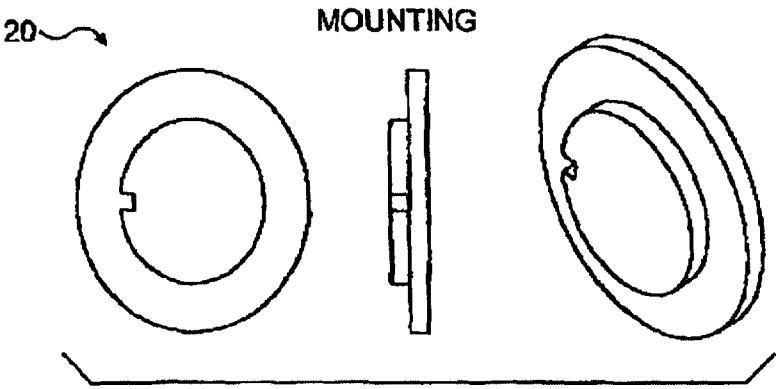
Figure 5C:
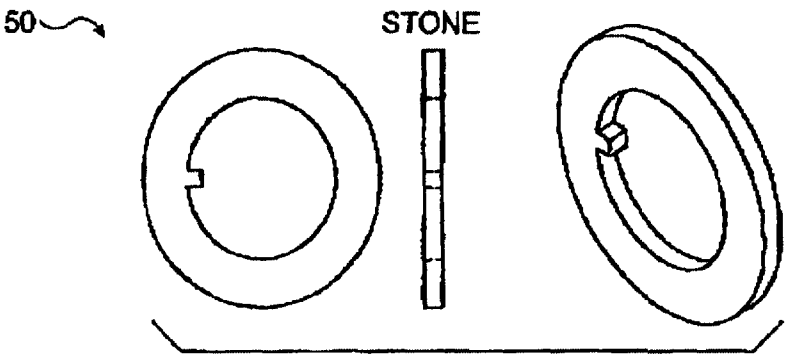

Referring to FIG. 5, system 10 is shown according to an alternative embodiment of the present invention. Frame 20 includes a protruding portion shown as a boss 32, similar to boss 28. Boss 32 is generally circular shaped and includes a recess shown as an inwardly extending finger 62. An aperture 58 of stone 50 is correspondingly generally circular shaped, and stone 50 includes a protrusion shown as an outwardly extending finger 30. Boss 60 fits within aperture 58 of stone 50 to interconnect fingers 30 and 62 such that stone 50 is rotated when frame 20 is rotated.

Figure 6B:
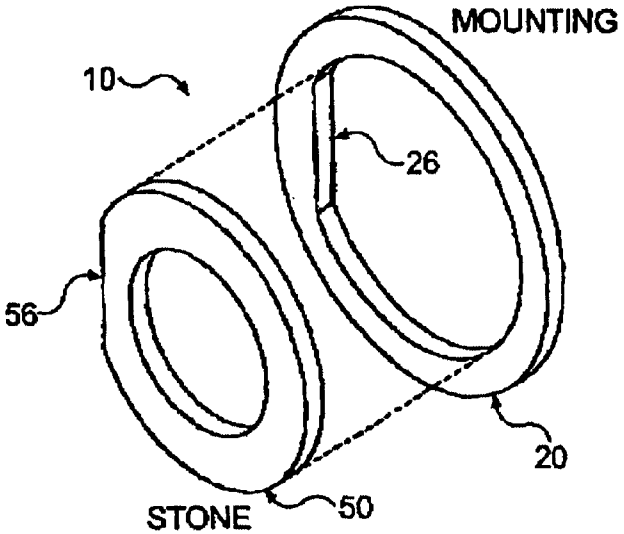
FIG. 6 is an exploded perspective view of the stone mounting system according to an alternative embodiment of the present invention.
Figure 6A:
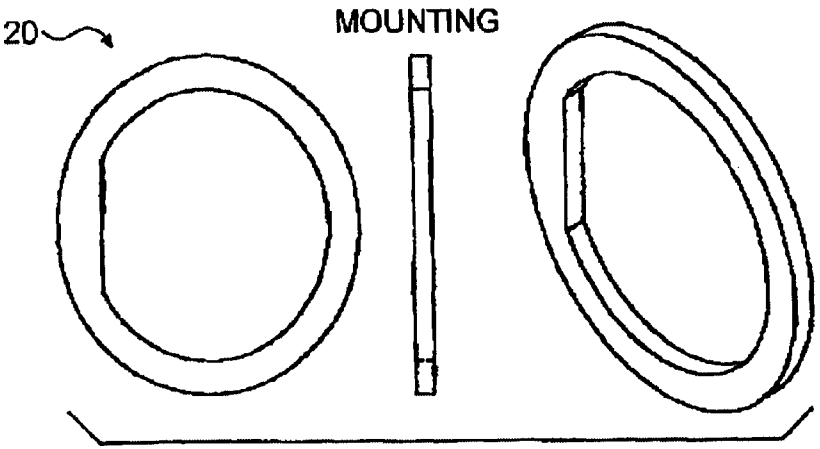
Figure 6C:
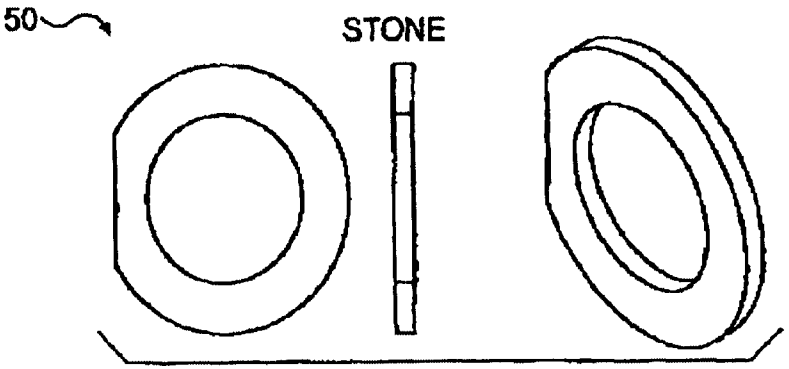

Referring to FIG. 6, system 10 is shown according to an alternative embodiment of the present invention. Aperture 22 of frame 20 is generally circular shaped and includes an oblique portion 26. The perimeter of stone 50 is correspondingly circular shaped and includes a corresponding oblique portion 56. The perimeter of stone 50 fits within aperture 22 and is aligned with frame 20 such that oblique portion 56 is aligned with oblique portion 26 such that stone 50 is rotated when frame 20 is rotated.

Figure 7B:
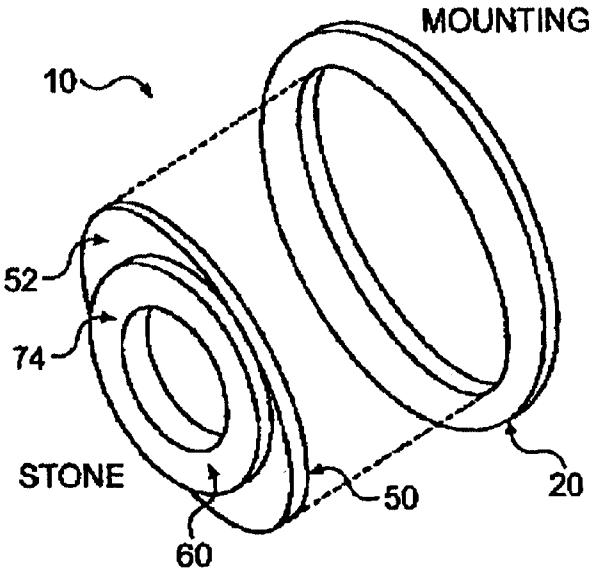
FIG. 7 is an exploded perspective view of the stone mounting system showing a stone boss according to an alternative embodiment of the present invention.
Figure 7A:
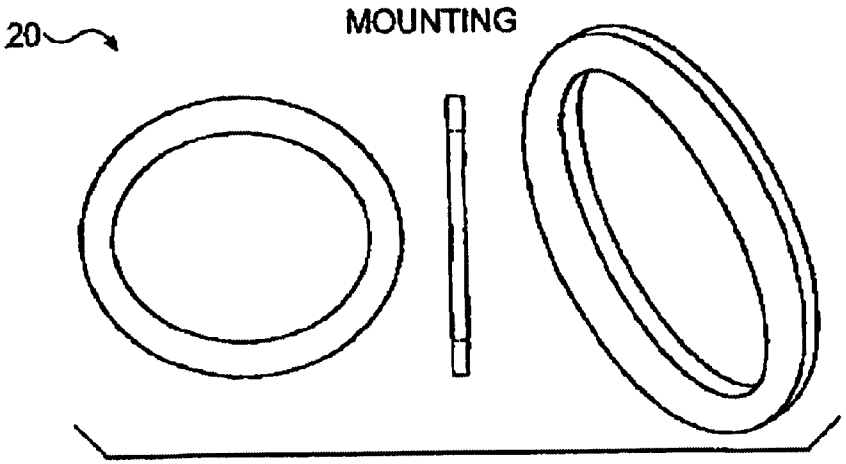
Figure 7C:
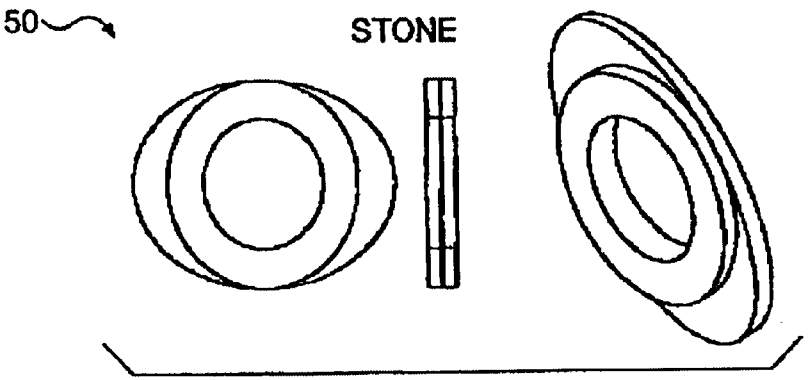

Referring to FIG. 7, system 10 is shown according to an alternative embodiment of the present invention. Aperture 22 of frame 20 is generally oval shaped and the perimeter of stone 50 is correspondingly oval shaped. Grinding surface 52 includes a protruding portion shown as a boss 60 extending from stone 50. Boss 60 provides a supplemental grinding surface 74 for reducing the size of grinding materials (not shown). Stone 50 fits within aperture 22 of frame 20 such that stone 50 is rotated when frame 20 is rotated.

Figure 8B:
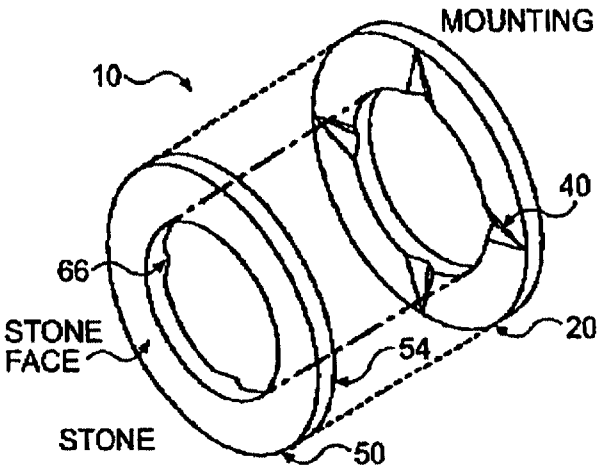
FIG. 8 is an exploded perspective view of the stone mounting system showing a recess configured to coact with a protrusion according to an alternative embodiment of the present invention and FIG. 9 is an exploded perspective view of the stone mounting system according to an alternative embodiment of the present invention.
Figure 8A:
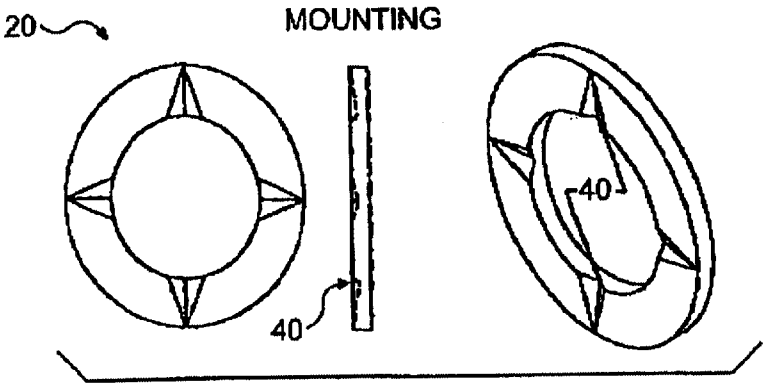
Figure 8C:
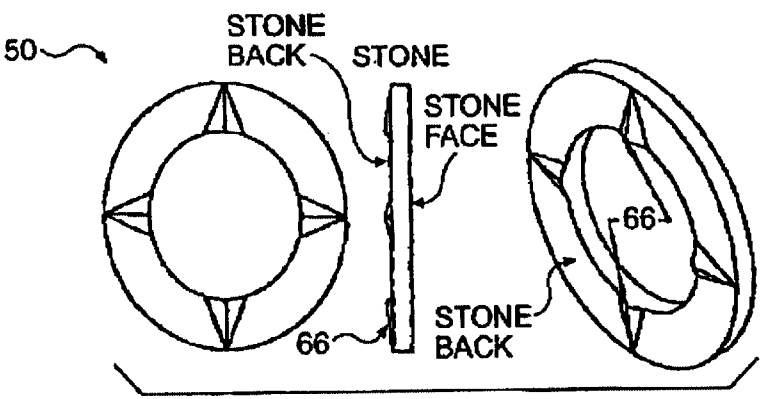

Referring to FIG. 8, system 10 is shown according to an alternative embodiment of the present invention. Frame 20 includes a recessed portion shown as a lock 40 having a generally triangular shape. Backing surface 54 of stone 50 includes a protrusion shown as a key 66 having a corresponding triangular shape. Key 66 fits within lock 40 of plate 20 such that stone 50 is rotated when frame 20 is rotated.

Figure 9B:
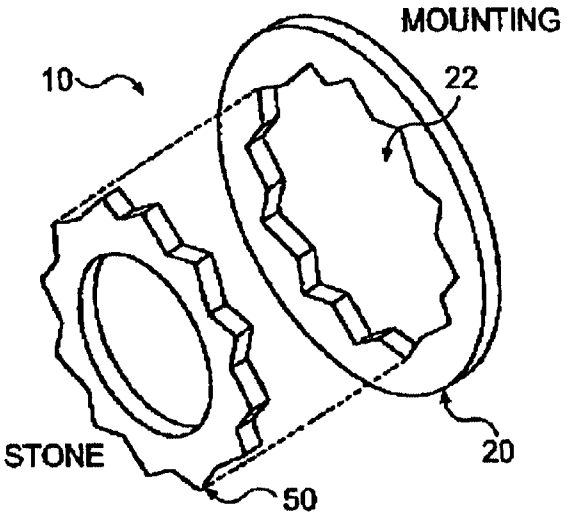
Figure 9A:
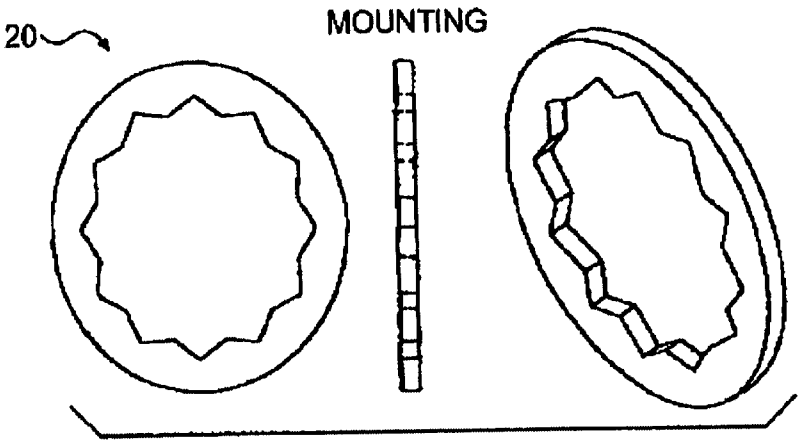
Figure 9C:
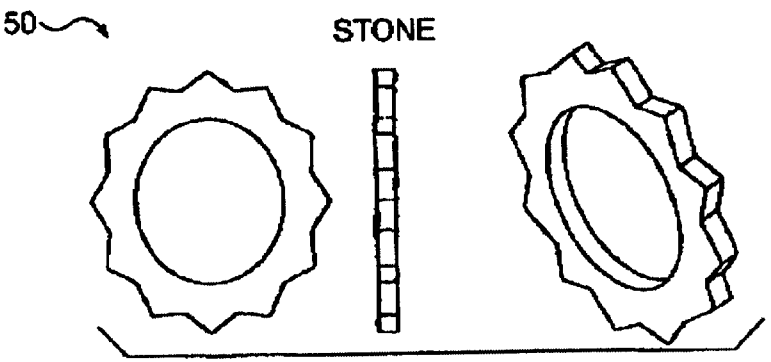

Referring to FIG. 9, system 10 is shown according to an alternative embodiment of the present invention. Aperture 22 of stone 20 is generally star shaped and the perimeter of stone 50 is correspondingly star shaped. Stone 50 fits within aperture 22 of frame 20 such that stone 50 is rotated when frame 20 is rotated.

Figure 10B:
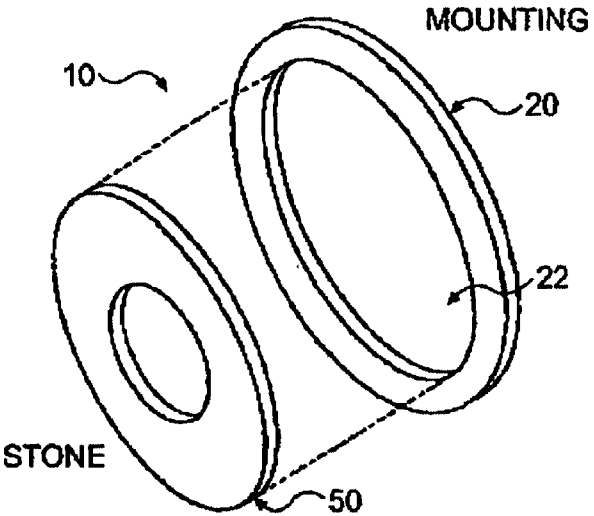
FIG. 10 is an exploded perspective view of the stone mounting system according to an alternative embodiment of the present invention.
Figure 10A:
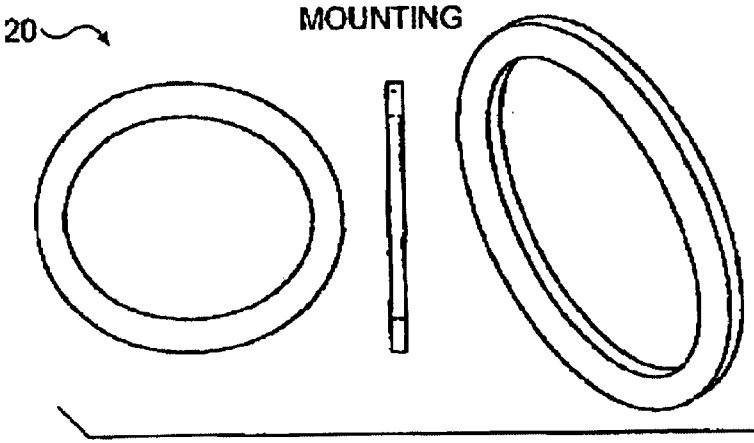
Figure 10C:
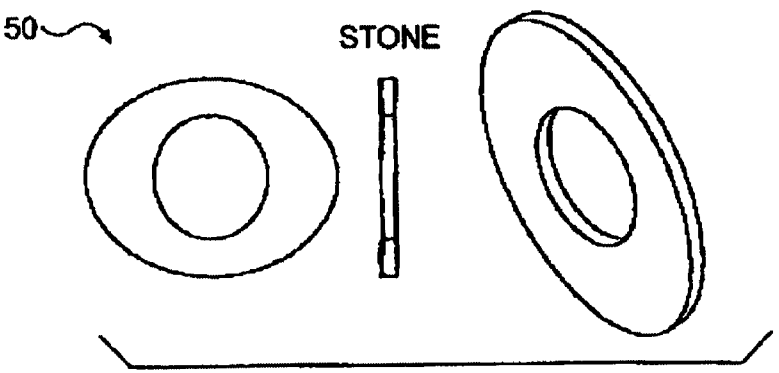

Referring to FIG. 10, system 10 is shown according to an alternative embodiment of the present invention. Aperture 22 of frame 20 is generally oval shaped and includes an aperture 22. The shape of the perimeter of stone 50 corresponds to the shape of aperture 22 in that it is generally oval. Stone 50 may be inserted within aperture 22 of frame 20 such that stone 50 is rotated when frame 20 is rotated. This embodiment applies rotational forces (loadings) on to two points, namely at the two narrower, elongated ends of the oval.

It is important to note that the construction and arrangement of the elements of the stone mounting system in the exemplary embodiments is illustrative only. Many variations are possible. According to alternative embodiments, the stone may be a unitary, contiguous piece or may be segmented into several pieces whereby each segment may be coupled with the frame to assemble the overall stone shape. The shape and configuration of the stone and the frame can be varied drastically. Examples of the shapes of the stones and frames are found but are not limited to those shown in the FIGURES, other shapes may include a square shaped stone coupled to an oval shaped frame. Complex stone shapes are envisioned such as star shapes, which engage a similar or correspondingly shaped frame. The mounting interface between the stone and the frame may be at the outer perimeter of the stone and/or frame, the inside perimeter of the stone and/or frame (e.g., the inside aperture or "donut"), at the perimeter of a boss or protrusion of the stone and/or frame, or a combination thereof. The stones can have various shaped grinding surfaces (e.g., beached or sloped, grooved, etc.) and various contours for improved commutation of materials.

According to alternative embodiments related to the locking system, keyway notches may be formed in the stone to accept notches associated with the frame. Also, the stone could have outwardly extending keys, which engage keyway notches in the frame. According to alternative embodiments related to the mounting interface between the stone and the frame, the stone and the frame may be coupled by fasteners such as bolts, adhesives (e.g., epoxies, glues, etc.), liquid metal (such as molten lead, sulfur, etc.), and the like. The stone may be pre-stressed before the grinder is operated (i.e., with locking taper mounting rings). According to other alternative embodiments, the stone may be substantially free of pre-stress (which, without intending to be limited by theory, is believed may reduce wear and increase longevity of the stone).

According to other alternative embodiments, the stone mounting system may be rotated or provided with translational motion at any speed from extremely high (e.g., about 3600 rpm) to extremely low (less than about 1 rpm). A preferable speed is between about 1800 rpm and about 3600 rpm.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and/or omissions may be made in the design, operating conditions and/or arrangement of the preferred embodiments without departing from the spirit of the invention as expressed in the appended claims. The order or sequence of steps, for example, of providing the stone or the frame may be varied or re-sequenced according to alternative embodiments of the invention.

In the claims, any means-plus-function clause is intended to cover the structures described herein as performing the recited function and not only structural equivalents but also equivalent structures.

What is claimed is:

1. A comminuting apparatus for reducing the size of particles, comprising:

a frame providing an internal perimeter and having a shape;

a stone having a grinding surface for grinding a material and providing a perimeter having a shape corresponding to the shape of the perimeter of the frame and configured to be at least partially surrounded by the frame;

wherein when the frame is rotated, the frame is configured to coact with the stone such that the stone is rotated at substantially the same rate as the frame;

and wherein both the frame and the stone include at least one geometric shape selected from the group consisting of oval, hexagonal, square, and star shapes, and wherein upon rotation of the frame, the at least one geometric shape of the frame coacts with the at least one geometric shape of said stone to thereby enable rotation of said stone but whereby said stone is substantially inhibited from independently rotating relative to said frame due to said geometric shapes, and wherein said stone is substantially unstressed in said frame.

2. A comminuting apparatus for reducing the size of particles, comprising:

a frame providing an internal perimeter and having a shape;

a stone having a grinding surface for grinding a material and providing a perimeter having a shape corresponding to the shape of the perimeter of the frame and configured to be at least partially surrounded by the frame;

wherein when the frame is rotated the perimeter of the frame is configured to contact with the perimeter of the stone such that the stone is rotated at substantially the same rate as the frame;

wherein the shape of the perimeter of the frame is substantially the same as the shape of the perimeter of the stone;

wherein the frame or the stone further includes an aperture;

wherein the perimeter of the frame abuts against the perimeter of the stone;

and wherein the stone or the frame further includes a boss, wherein said boss is adapted to be received within said aperture, and wherein said stone is substantially unstressed in said frame.

3. A comminuting apparatus for reducing the size of particles, comprising:

a frame providing an internal perimeter and having a shape;

a stone having a grinding surface for grinding a material and providing a perimeter having a shape corresponding to the shape of the perimeter of the frame and configured to be at least partially surrounded by the frame;

wherein when the frame is rotated the perimeter of the frame is configured to contact with the perimeter of the stone such that the stone is rotated at substantially the same rate as the frame;

wherein the frame further includes a protrusion and the stone further includes a recess for selectively mating with the protrusion such that when the stone is in a mated position the stone is coupled to the protrusion;

wherein shape of the perimeter of the frame is substantially the same as the shape of the perimeter of the stone;

wherein the perimeter of the frame abuts against the perimeter of the stone, and wherein said stone is substantially unstressed in said frame.

4. A comminuting apparatus for reducing the size of particles, comprising:

a frame providing an internal perimeter and having a shape;

a stone having a grinding surface for grinding a material and providing a perimeter having a shape corresponding to the shape of the perimeter of the frame and configured to be at least partially surrounded by the frame;

wherein when the frame is rotated the perimeter of the frame is configured to contact with the perimeter of the stone such that the stone is rotated at substantially the same rate as the frame;

wherein the shape of the perimeter of the frame is substantially the same as the shape of the perimeter of the stone;

wherein the frame further includes an aperture and the perimeter of the stone is configured to fit within the aperture;

wherein the perimeter of the frame abuts against the perimeter of the stone;

and wherein the frame has multiple oblique flats that optionally do not intersect with one another, and wherein said stone is substantially unstressed in said frame.

5. A comminuting apparatus for reducing the size of particles, comprising:

a frame providing an internal perimeter and having a shape;

a stone having a grinding surface for grinding a material and providing a perimeter having a shape corresponding to the shape of the perimeter of the frame and configured to be at least partially surrounded by the frame;

wherein when the frame is rotated the perimeter of the frame is configured to contact with the perimeter of the stone such that the stone is rotated at substantially the same rate as the frame;

wherein the shape of the perimeter of the frame is substantially the same as the shape of the perimeter of the stone;

wherein the frame further includes an aperture and the perimeter of the stone is configured to fit within the aperture;

wherein the perimeter of the frame abuts against the perimeter of the stone;

and wherein the stone further includes at least two segments, and wherein said stone is substantially unstressed in said frame.

* * * * *